US005862812A

United States Patent [19]

Dumler

[11] Patent Number: 5,862,812

[45] Date of Patent: Jan. 26, 1999

[54] MASCARA BRUSH

[75] Inventor: Norbert Dumler, Ansbach, Germany

[73] Assignee: georg karl geka-brush GmbH, Bechhofen-Waizendorf, Germany

[21] Appl. No.: 954,754

[22] Filed: Oct. 20, 1997

[30] Foreign Application Priority Data

Oct. 23, 1996 [DE] Germany ..... 296 18 479 U

[51] Int. Cl.[6] ..... A45D 40/26

[52] U.S. Cl. ..... 132/218; 15/206; 15/160; 401/129

[58] Field of Search ..... 132/218, 216, 132/320, 120; 401/126, 129; 15/DIG. 5, 206, 207, 207.2, 106

[56] References Cited

U.S. PATENT DOCUMENTS

| | | | |
|---|---|---|---|
| 4,628,950 | 12/1986 | Bitzer | 132/218 |
| 5,339,841 | 8/1994 | Gueret | 132/218 |
| 5,357,987 | 10/1994 | Schrepf | 132/218 |
| 5,370,141 | 12/1994 | Gueret | 132/218 |
| 5,482,059 | 1/1996 | Miraglia | 132/218 |
| 5,542,439 | 8/1996 | Gueret | 132/218 |
| 5,709,230 | 1/1998 | Miraglia | 132/216 |

FOREIGN PATENT DOCUMENTS

| | | |
|---|---|---|
| 0 306 052 | 3/1989 | European Pat. Off. . |
| 0 663 161 | 7/1995 | European Pat. Off. . |
| 33 05 669 | 8/1984 | Germany . |
| 44 46 521 | 6/1996 | Germany . |

*Primary Examiner*—Gene Mancene
*Assistant Examiner*—Pedro Philogene
*Attorney, Agent, or Firm*—Browdy and Neimark

[57] ABSTRACT

In a mascara brush comprising a plurality of bristles retained between two intertwisted wire sections, the bristles being trimmed to define the contour of the brush, it is provided, with a view to obtaining clearly improved handling and combing properties, that the bristles are trimmed so that on the one hand, seen in a cross-section, they are asymmetric in such a way that the bristles have a shorter extension from the intertwisted wire sections towards one side while having a longer extension towards the other side, and that on the other hand, seen in a longitudinal section, the bristles are also trimmed asymmetrically in such a way that they have varying lengths.

5 Claims, 1 Drawing Sheet

MASCARA BRUSH

BACKGROUND OF THE INVENTION

1. Field of the Invention

The invention relates to a mascara brush comprising a plurality of bristles retained between two intertwisted wire sections, the bristles being trimmed to define the contour of the brush.

2. Background Art

Mascara brushes serve for the application of mascara from a reservoir onto the lashes. A fundamental demand on brushes of the generic type consists of ensuring sufficient transfer of mascara on the one hand and advantageous combing and care properties on the other.

Conventionally, mascara brushes are manufactured in such a way that bristles are held between two intertwisted wire sections, the contour of the brush being shaped by trimming the bristle tips after the intertwisting operation. The most frequent contour is a cylindrical configuration, because such a symmetric cut can easily be produced by the brush being moved in rotation along stationary knives.

In principle, it is also known to design the length of the bristles asymmetrically relative to the central longitudinal axis of the brush. To this end, rotating knives can be provided, having an axis of rotation out of the central longitudinal axis of the brush.

In order to obtain combing properties that vary along the brush, it is further known, during the equipment of the brush, to provide bristles of varying properties, for instance varying thickness and/or rigidity.

SUMMARY OF THE INVENTION

It is the object of the invention to embody a mascara brush of the type mentioned at the outset in such a way that owing to its configuration, it possesses clearly improved handling and combing properties.

According to the invention, this object is solved by the bristles being trimmed so that on the one hand, seen in a cross-section, they are asymmetric in such a way that the bristles have a shorter extension from the intertwisted wire sections towards one side while having a longer extension towards the other side, and that on the other hand, seen in a longitudinal section, the bristles are also trimmed asymmetrically in such a way that they have varying lengths.

In this case, it is advantageously provided that seen in a longitudinal section, the bristles of the front and rear end portion are shorter than those of the central portion.

In keeping with an especially advantageous embodiment, provision is made for the contour of the bristles to be arched from the front to the rear end, bulging in the central portion.

As a result of this configuration according to the invention, the longer bristles of the central portion, which projects from the rest of the brush body, ensure a precisely defined application of mascara, whereas the marginal bristles as well as the even shorter bristles on the opposite side can be used for combing the lashes.

The asymmetric cut increases the storage of substance and helps form a defined combing zone. Correspondingly, application is possible without interruption and rotation. This facilitates the upsweeping process. Furthermore, excellent combing of the arch of lashes is possible. The tapering at the upper end serves to reduce any soiling of the bottle neck when the brush is returned into the reservior.

In keeping with a preferred embodiment, the number of turns of the intertwisted wire sections amounts to at least 18 and the number of bristles per turn is at least 10, given a wire diameter of at least 0.4 mm and a trimming length per turn of 1.0 mm to 2.0 mm.

Details of the invention will become apparent from the ensuing description of a preferred exemplary embodiment, taken in conjunction with the drawing.

DESCRIPTION OF THE PREFERRED EMBODIMENT

Figure 1:
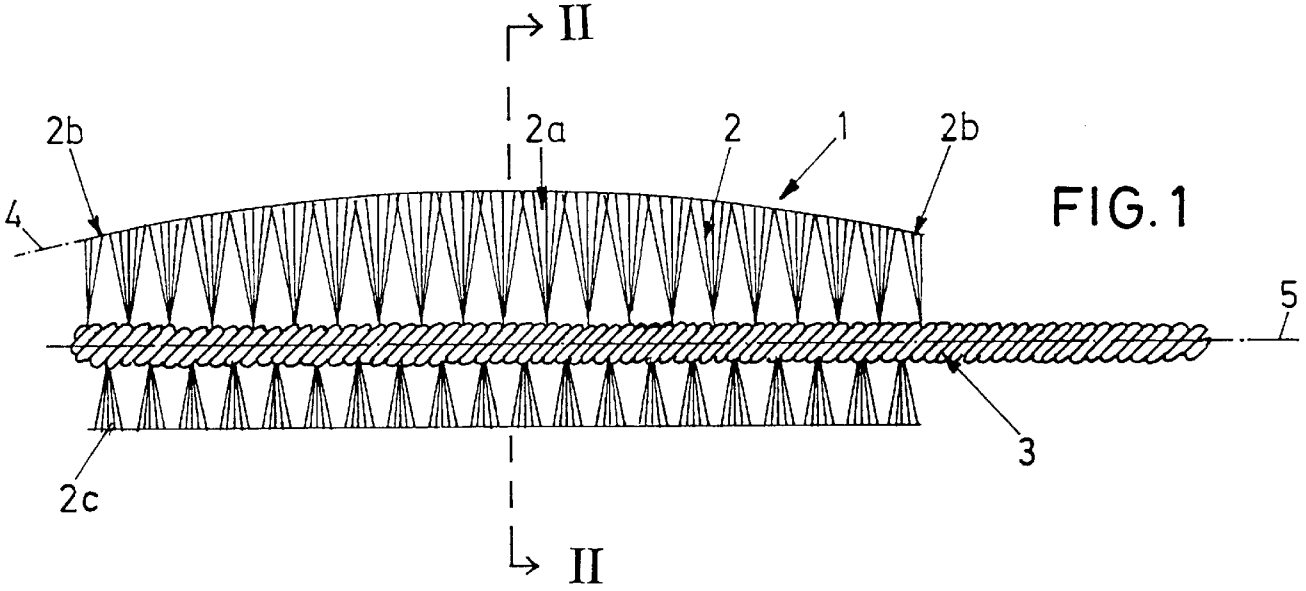
FIG. 1 is a longitudinal section through a mascara brush according to the invention.

A mascara brush 1 seen in the drawing comprises a plurality of bristles 2 which, in a manner known per se, are retained between intertwisted wire sections of U-shaped bending, thus forming a handle.

Seen in a longitudinal section (cf. FIG. 1), the bristles 2 are trimmed in such a way that the bristles 2*a* of the central portion are longer than the bristles 2*b* of the two end portions, the envelope curve 4 of the bristles being arched in the longitudinal direction.

Figure 2:
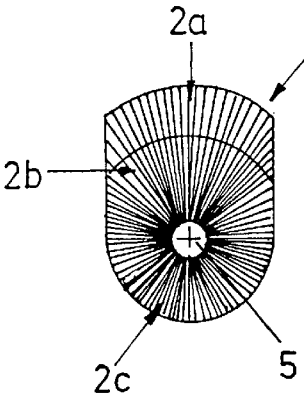
FIG. 2 is a section on the line II—II of FIG. 1.

Seen in a cross-section (cf. FIG. 2), the mascara brush 1 is also trimmed asymmetrically relative to the central longitudinal axis 5 in as much as the downward bristles 2*c* are shorter than the upward bristles 2*a*, 2*b*.

What is claimed is:

1. A mascara brush comprising a plurality of bristles retained between two intertwisted wire sections, the bristles being trimmed to define the contour of the brush, wherein in a cross-section perpendicular to a longitudinal axis of said two intertwisted wires the bristles (2) are trimmed to be asymmetric in such a way that the bristles (2) have a shorter extension from the intertwisted wire sections from a first side of said intertwisted wire sections while having a longer extension from a second side of said intertwisted wire sections, and when seen along said longitudinal axis, the bristles (2) are also trimmed asymmetrically in such away that they have varying lengths, wherein a contour of the bristles (2) along said longitudinal axis on the second side of said intertwisted wire sections is arched from first bristles of said bristles to last bristles of said bristles respectively from a front of the brush toward a rear of the brush, the bristles bulging in a central portion thereof, and wherein the wire diameter is at least 0.4 cm.

2. A mascara brush according to claim 1, wherein seen in a longitudinal section, the bristles (2) of the front and rear end portion are shorter than those of the central portion.

3. A mascara brush according to claim 1, wherein the number of turns of the intertwisted wire sections (3) is at least 18.

4. A mascara brush according to claim 1, wherein the number of bristles (2) per turn is at least 10.

5. A mascara brush according to claim 1, wherein the brush (1) has a trimming length per turn ranging from 1.0 mm to 2.0 mm.

* * * * *

UNITED STATES PATENT AND TRADEMARK OFFICE

CERTIFICATE OF CORRECTION

PATENT NO. : 5,862,812

DATED : Jan. 26, 1999

INVENTOR(S) : Norbert Dumler

It is certified that error appears in the above-identified patent and that said Letters Patent is hereby corrected as shown below:

Column 2, line 53 (last line of Claim 1), delete "0.4 cm" and insert therefor --0.4 mm--, i.e. changing "cm" to "mm".

Signed and Sealed this

Third Day of August, 1999

*Attest:*

*Attesting Officer*

Q. TODD DICKINSON

*Acting Commissioner of Patents and Trademarks*